US005351463A

United States Patent [19]

Aarts

[11] Patent Number: 5,351,463

[45] Date of Patent: Oct. 4, 1994

[54] METHOD AND APPARATUS FOR MAKING A FILLED AND CLOSED VACUUM PAK

[75] Inventor: Mathias L. C. Aarts, Bilthoven, Netherlands

[73] Assignee: Sara Lee/DE N.V., Utrecht, Netherlands

[21] Appl. No.: 971,156

[22] Filed: Nov. 5, 1992

[30] Foreign Application Priority Data

Nov. 7, 1991 [NL] Netherlands ..... 9101862

[51] Int. Cl.[5] ..... B65B 7/06; B65B 31/02; B65B 51/14

[52] U.S. Cl. ..... 53/434; 53/479; 53/481; 53/512; 53/370.6; 53/371.8

[58] Field of Search ..... 53/370.6, 370.7, 371.8, 53/372.2, 86, 405, 434, 479, 481, 512

[56] References Cited

U.S. PATENT DOCUMENTS

| | | | |
|---|---|---|---|
| 2,161,071 | 6/1939 | McGrath et al. | 53/434 X |
| 2,202,375 | 5/1940 | Gott | 53/434 X |
| 2,859,796 | 11/1958 | Taunton | 53/479 X |
| 4,457,122 | 7/1984 | Atkins et al. | 53/512 X |
| 4,583,347 | 4/1986 | Nielson | 53/512 X |
| 4,706,441 | 11/1987 | Chervalier | 53/512 |
| 4,756,140 | 7/1988 | Gannon | 53/512 X |
| 5,170,609 | 12/1992 | Bullock et al. | 53/512 X |

FOREIGN PATENT DOCUMENTS

| | | | |
|---|---|---|---|
| 0056345 | 7/1982 | European Pat. Off. | 53/434 |
| 0225064 | 6/1987 | European Pat. Off. . | |
| 388310 | 9/1990 | European Pat. Off. . | |
| 2708444 | 8/1978 | Fed. Rep. of Germany . | |

*Primary Examiner*—Linda B. Johnson
*Attorney, Agent, or Firm*—Longacre & White

[57] ABSTRACT

The present invention describes a method and apparatus for closing a filled vacuum pack package. The open end of the package, which is made from a thin-wall, flexible foil, is folded above the height of the product in the package. The package is placed in a vacuum chamber, a vacuum is drawn on the contents of the package, and the open end of the packaged is closed airtightly by a closing mechanism. While in the vacuum chamber, the open end of the package, which is not yet completely folded, is folded by a flexible part of the vacuum chamber wall facing the open end of the package. The flexible part of the vacuum chamber is folded inwardly by applying a pressure on its exterior which is greater than the vacuum pressure therein.

17 Claims, 7 Drawing Sheets

METHOD AND APPARATUS FOR MAKING A FILLED AND CLOSED VACUUM PAK

This invention relates to a method and apparatus for making a filled and closed vacuum pack.

It is known to make such a vacuum pack by first forming a package which is open at the top from a thin-walled and flexible packaging foil. The package so formed is filled with the product to be packaged, whereafter the filled package is folded up at the top of the filling. The package or at least the upper part thereof is subsequently introduced into a vacuum chamber, where the contents of the package are vacuumized. Finally, the upper end of the package under vacuum is closed airtightly by means of closing means.

Such a method, as described in European patent application published under no. 0 388 310, has a number of disadvantages.

After the package has been filled, the upper end thereof is folded up, but not airtightly. The reason is that it must still be possible for the contents of the package to be vacuumized via the residual opening in the end of the package that has been folded up. In particular when the package is filled with fine-grained material such as ground coffee, the pressure in the vacuum chamber should not be adjusted too rapidly from an atmospheric pressure to the eventually desired reduced pressure in the package. It must be possible for the air and/or any other gas present in the package to leave the package through the narrow slit-shaped opening at the top. If the vacuum chamber is adjusted rapidly to the desired final reduced pressure, the velocity of the air egressing from the small opening will be so high that granular material may thereby be swept along from the package to the exterior. This gives rise to loss of filling, the vacuum chamber is polluted and material particles may stick to the inner wall of the package, giving rise to the risk of the package not being closed airtightly at that location.

These problems could be solved by vacuumizing the package while it is still fully open at the upper end or is folded up only partly, so that a large opening remains present for the purpose of vacuumization. The pressure in the vacuum chamber can then be reduced rapidly since the outflow velocity of the air is limited owing to the large outflow area. With this solution, the package must still be folded up at the top after being vacuumized and before being closed airtightly. This means that a folding device must be installed in the vacuum chamber for carrying out this step.

The incorporation of a folding device in the vacuum chamber meets with objections again. The installation is complex and costly, in particular when such a folding device is required for each vacuum chamber in a fast-running machine equipped with many such vacuum chambers. Further, the incorporation of a folding device in the vacuum chamber considerably increases the volume of the vacuum chamber to be evacuated. This means not only that more vacuum capacity and energy are required but, in particular, that evacuating the vacuum chamber to the required pressure takes longer and thus prolongs the cycle time for the production of a package. Also, checking the proper operation and maintenance of the folding device in the vacuum chamber cannot be done as readily as with a folding device arranged outside the vacuum chamber.

The object of the invention is to provide a solution to the problems outlined hereinabove.

To that end, the invention provides a method for making a filled and closed vacuum pack, in which the open upper end of a package made from a thin-walled and flexible packaging foil and filled with a product to be packaged is folded up above the filled part of the package, the contents of the package are vacuumized in a vacuum chamber, and the upper end of the package under vacuum is closed airtightly by means of closing means, characterized in that in the vacuumized vacuum chamber the upper end of the package, which has not or incompletely been folded up, is folded up by a flexible part of the wall of the vacuum chamber, located opposite the upper end of the package.

The invention further comprises an apparatus for making a filled and closed vacuum pack, comprising:

folding means for folding up the upper end of a package made from a thin-walled and flexible packaging foil, this upper end being located above the part of the package that is filled with a product to be packaged, a vacuum chamber for vacuumizing the contents of the package placed in the vacuum chamber; and closing means for closing the package under vacuum airtightly, characterized in that the wall of the vacuum chamber at the upper end thereof is designed with a flexible part for folding up the upper end of the package, which has not or incompletely been folded up, in the vacuumized vacuum chamber.

According to the invention, the package, when introduced into the vacuum chamber, does not have its upper end folded up yet or at any rate not yet folded up into the eventual desired shape. Only in the closed vacuum chamber is the package folded up completely. At the outset of the evacuation of the vacuum chamber, when the amount of air in the package is largest, a large outflow opening is available at the top of the package, which is still open completely or for the greater part. When, after the required reduced pressure has been achieved, the upper end is folded up completely and, as a consequence, the outflow opening has become small, the amount of air that is still to be removed from the package has also become small. Thus, rapid evacuation of the package can be effected without entailing the disadvantages arising during the evacuation of a package that is already folded up completely when introduced into the vacuum chamber.

Although according to the invention the package is not folded up completely until in the vacuum chamber, the step of folding up the package can be carried out without necessitating installation of a separate folding device in the vacuum chamber. This is made possible in that no longer use is made of a rigid vacuum chamber as is conventional, but of a vacuum chamber that is flexible in its entirety, for the greater part thereof or at least at the upper end thereof. In that case, as the package is vacuumized in the vacuum chamber, the upper end of the vacuum chamber, made of flexible design, located closely opposite the upper end of the package, is folded inwards as a result of the vacuum and a higher pressure applied to the outside (normally the atmospheric pressure), and thereby the upper end of the package is folded up. In fact, the vacuum chamber thus acquires a double function: that of vacuum chamber as such and that of folding mechanism.

The flexible vacuum chamber is so constructed that as the difference in pressure on the inner wall and the outer wall is generated, the vacuum chamber folds against the outer wall of the package according to the desired pattern. The vacuum chamber will continue to fold inwards until the walls of the vacuum chamber come to rest against each other. During and through this motion, the foil of the package, too, is folded conformably until, in the final position of the vacuum chamber, the upper end of the package has been folded up completely. This process is preferably carried out in such a manner that the time at which the folding step is terminated practically coincides with the time at which the desired degree of reduced pressure in the package has been achieved.

The walls of the vacuum chamber may be located closely opposite the package placed therein. Here, the invention offers the important further advantage that the volume of the space in the vacuum chamber to be evacuated is small, so that little vacuum capacity is required and evacuation can be effected rapidly.

Suitable materials for the vacuum chamber, or at any rate the flexible part thereof, are rubber or plastics. Preferably, the shape of the vacuum chamber in inoperative position corresponds to that of the package to be processed, with a slight clearance between the inner wall of the vacuum chamber and the outer wall of the package.

The flexible end of the vacuum chamber may be provided with folding lines at the locations where the folds are desired. These folding lines may for instance be formed by line-shaped thinner or thicker portions in the wall of the vacuum chamber which, for the rest, is of equal thickness. It is also possible that the flexible wall folds inwards according to the desired pattern all by itself, i.e., without the help of folding lines or other auxiliary means, exclusively under the influence of the vacuum. If so desired, the folding of the vacuum chamber can be supported by externally arranged folding means.

Further, it is not always necessary to make the upper end of the vacuum chamber completely flexible. The upper end of the vacuum chamber may for instance be made up of rigid plate-shaped parts interconnected for flexible or hinging motion along the folding lines desired for folding.

In known apparatus for making vacuum packs, the closing means for airtightly closing (sealing) the package after evacuation are arranged in the vacuum chamber. In the present invention, this in not necessary. In the position where the vacuum chamber is folded inwards completely, the part of the package that remains as an upright edge above the part of the package that has been folded up is firmly clamped by and between the walls of the vacuum chamber. If the upright edge is clamped sufficiently tightly, it is closed airtightly during clamping. This makes it possible for the closing means for the permanent airtight closure of the package to be arranged outside the vacuum chamber at a short distance above the folded upper end of the package, where the upright edge of the package is sealed, or closed airtightly in any other manner, by the closing means.

This possibility of arranging the closing means outside the vacuum chamber proper, so that in fact the vacuum chamber only contains the package, is another advantage of the invention.

For the permanent airtight closure of the package, the closing means are typically pressed mechanically against the package, with the opposite walls of the package, when they have been pressed against each other, being heated and fused by means of the electrically heated sealing jaws arranged in the closing means. Optionally, the sealing jaws may be incorporated into the wall or against the inside of the wall of the flexible vacuum chamber in the form of sealing strips. Heating can be effected by electrical resistance heating or by using a high-frequency electrical field at the location of the closure to be provided.

It is also possible to incorporate metal strips in or against the packaging foil, which are capable of being heated by magnetic induction for fusing the package at that location.

The airtight closure can also be obtained by local glueing.

The flexible part of the vacuum chamber is returned to the unfolded starting position again after the vacuum has been removed. Thus, the ready package can be removed and a next filled but still open package can be placed in the vacuum chamber. Optionally, an unfilled package is placed in the vacuum chamber and then filled with a product in the vacuum chamber.

The flexible part of the vacuum chamber may be made of a resilient material which, after the vacuum has been removed, springs back into the unfolded position. In that case, the motion of the flexible vacuum chamber, both during folding and upon termination of the production of the package, is entirely automatic and no separate mechanisms are required for folding up and opening the vacuum chamber.

Preferably, the flexible vacuum chamber is arranged in a rigid container. In this embodiment, before the package is introduced into the vacuum chamber, the space between the container and the vacuum chamber is vacuumized so as to cause the flexible part of the vacuum chamber to move towards the container. Thus, the package can be introduced into the vacuum chamber without difficulties. After the vacuum in the space between the vacuum chamber and the container has been removed, the vacuum chamber is evacuated internally so as to vacuumize the package. In similar manner, the vacuum chamber can also be enlarged temporarily with a view to removing the package from the vacuum chamber.

The embodiment with a rigid container around the vacuum chamber offers the further possibility of keeping the still unfolded package in the vacuum chamber open, also during vacuumization in the vacuum chamber, without the upper end of the package being folded up already at this time. To that end, also during vacuumization in the vacuum chamber, a vacuum is maintained or created in the space between the rigid container and the exterior of the vacuum chamber, namely, at a lower pressure than the vacuum pressure in the vacuum chamber. In this situation, the flexible wall of the vacuum chamber is not pressed against the upper end of the package, so that the upper end is not folded yet. As a result, during evacuation of the package a large opening remains present for the outflow of air from the package. Directly after the desired degree of vacuum in the package has been achieved, the reduced pressure in the space between the rigid container and the vacuum chamber is removed or in any event the pressure is raised to a value higher than the pressure in the vacuum chamber, so that the upper end of the vacuum chamber now comes to bear on the package and folds up the upper end of the package. Optionally, directly after vacuumization of the package, compressed air can be admitted to the space between the rigid container and the vacuum chamber so as to accelerate the package being folded up.

The invention will now be further explained, by way of example only, with reference to the accompanying schematic drawings. In these drawings:

FIG. 8 shows a different embodiment of the vacuum chamber while

Figure 1:
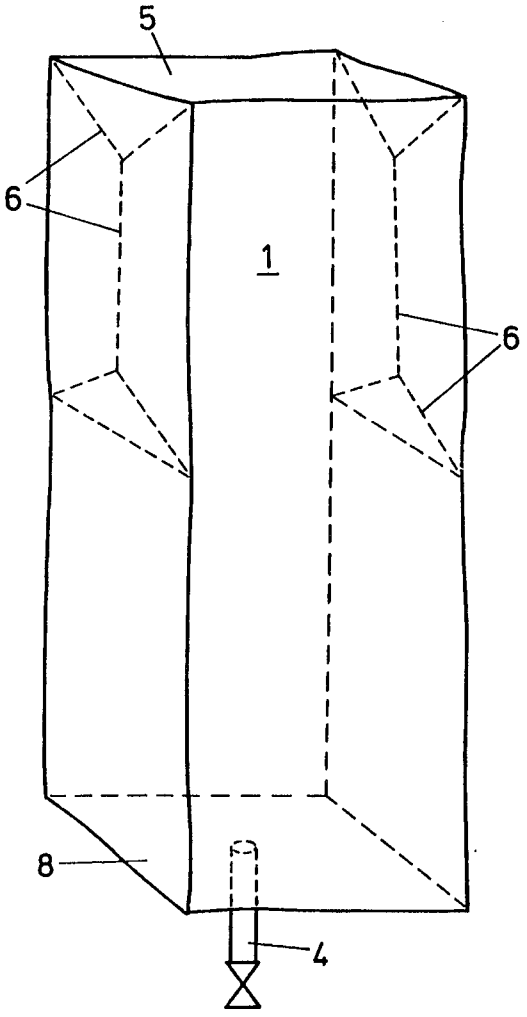
FIG. 1 shows a vacuum chamber for use in the invention.

FIG. 1 shows a perspective side view of a vacuum chamber 1 made from sheet-shaped rubber. The vacuum chamber is designed with rectangular horizontal and vertical cross-sections. The upper end face 5 of the vacuum chamber is constructed as a stiff plate. Mounted in the bottom end face 8 of the vacuum chamber is a connection 4 capable of being connected via a valve with a source of vacuum. Provided in the two narrow sidewalls of the upper part of the vacuum chamber are folding lines 6 designed as line-shaped thinner portions of the walls.

Figure 2:
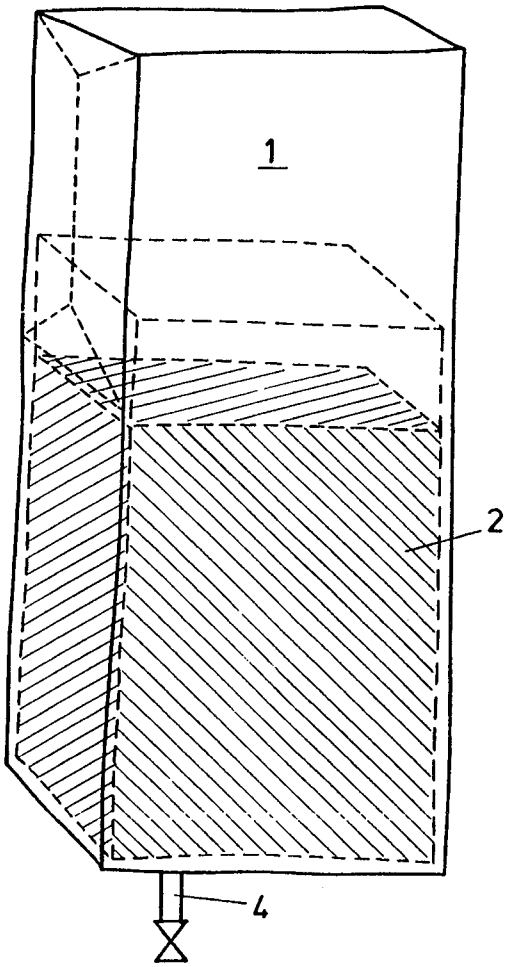
FIG. 2 shows the vacuum chamber of FIG. 1 having arranged therein the filled package open at the top.

In FIG. 2, a filled package 2, made from thin-walled and flexible packaging material, has been placed in the vacuum chamber. The shape of the vacuum chamber has been adapted to the shape of the filled package, with the vacuum chamber, viewed in horizontal cross-section, being only slightly larger than the package. The lowermost horizontal folding line in the vacuum chamber is located at the level of the top surface of the filling in the package. The package is still completely open at the upper end thereof, i.e., the shape of the unfilled part of the package is the same as that of the filled part. The package can be placed in empty condition in the vacuum chamber and subsequently be filled there, but preferably the package has already been filled before being placed in the vacuum chamber. The upper end face 5 or the bottom end face 8 (or both) are removable so that the package can be placed in the vacuum chamber. The bottom face 8 can also be formed by a removable table or platform on which the shell-shaped vacuum chamber, open at the bottom, can be secured so as to be airtight. Upon detachment of the shell-shaped vacuum chamber from the table, a package can be introduced into the vacuum chamber and later be removed therefrom.

When the filled package has been disposed in the entirely closed vacuum space in the vacuum chamber, the connection 4 is connected to a vacuum pump. Under the influence of the vacuum in the vacuum space and the atmospheric external pressure on the vacuum chamber, the flexible upper end of the vacuum chamber around and above the filling in the package is folded inwards along the folding lines 6 in the vacuum chamber to pleat the vacuum chamber and old the package. The flexible upper end of the vacuum chamber thereby presses inwards the oppositely located open upper end of the package, thereby folding up the open upper end of the package in corresponding manner.

During vacuumization via the connection 4, vacuum is applied to the contents of the package. This vacuumization can be effected rapidly since at the outset the package is still entirely open at the top. During vacuumization, the package is gradually folded up at the top by the vacuum chamber. When the walls of the flexible upper end of the vacuum chamber cannot move further inwards, the upper end of the package is folded up completely between the folds of the vacuum chamber. The extraction of air from the vacuum chamber can be controlled in such a manner that when this situation is achieved, the desired degree of vacuum in the package now folded up is achieved at the same time. If, however, in the package finally folded up completely, the eventually desired reduced pressure has not been reached yet, which necessitates continued vacuumization, the last minor amounts of air can escape from the package via the upper end of the package which, although folded up, has not been closed airtightly yet. Owing to the minor flow rate of the residual air egressing from the package, this does not lead to the above-mentioned problems with the known methods.

Above the folded-up upper end of the package, an upright portion remains, against which closing means 7 are now pressed. The closing means are heated and thereby they heat, for instance, a fusible inside layer present at that point on the inside of the packaging material. The two oppositely located inside layers are thereby fused together so that the package is closed airtightly. It is therefore not necessary to arrange the sealing means in the vacuum chamber.

It is possible that, as the reduced pressure required for the package is achieved, the vacuum chamber presses against the upright portion of the package with such force that, as a result, during this exertion of pressure, the package is clamped so as to be airtight. This means that in this case the sealing means 7 need to be pressed against the vacuum chamber only with such force as is necessary for fusing together the inside layers of the package. If necessary, to ensure that the vacuum chamber exerts such a pressure on the package that it is rendered airtight, it is possible to bring an external pressure to bear on the exterior of the vacuum chamber that is higher than the atmospheric external pressure, for example a pressure of 2 bar, so that the upper end of the package is pressed together with greater force.

After the package has been closed by means of the sealing means so as to be permanently airtight, the package can be removed from the vacuum chamber. In the conventional manner, the part of the package above the sealing joint can now be cut off and the upright portion with the sealing joint can be bent over horizontally against the folded upper surface of the package and optionally be adhered thereto, for instance by means of an adhesive strip.

Figure 4A:
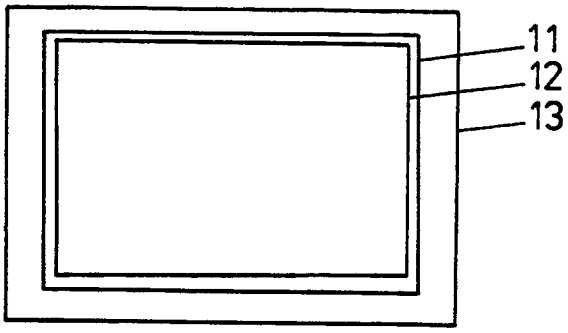
FIG. 4A shows a horizontal section of the combination of FIG. 4.
Figure 4:
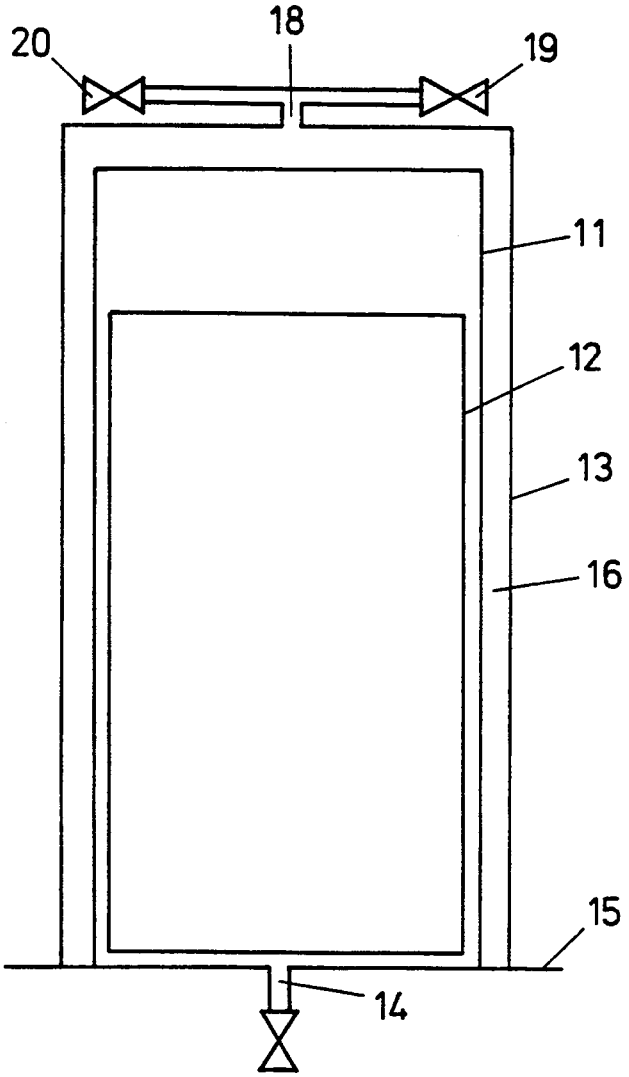
FIG. 4 shows a vertical section of a vacuum chamber with a filled package, the whole being arranged in a rigid container.

In the embodiment of FIG. 4, the vacuum chamber 11, with the package 12 arranged therein, has been placed in a rigid container 13. The lower edges of the vacuum chamber and the rigid container have been joined together permanently so as to form a space 16 between the vacuum chamber and the rigid container, closed off from the atmosphere. The vacuum chamber is open at the bottom end thereof to enable a package to be placed therein or removed therefrom. The combination of vacuum chamber and container can, by the lower edge thereof, be arranged airtightly on a platform 15 so as to form a space in the vacuum chamber that is likewise closed off from the atmosphere. Provided on the container is a connection 18 for the supply of compressed air to the space 16, via valve 19. The connection 18 can also be connected to a vacuum pump via valve 20.

When the apparatus according to FIG. 4 is used, first the space 16 is vacuumized via connection 18 and valve 20. As a result, the flexible wall of the vacuum chamber will move towards the wall of the container. The package 12 can then be introduced easily into the vacuum chamber which is open at the bottom at this time. The whole is then placed on the platform 15, with the vacuum chamber being closed airtightly at the bottom. Then, via valve 19, the space 16 is either set in communication with the atmosphere or connected to a source of compressed air. Further, the vacuum chamber is vacuumized via connection 14.

Figure 3:
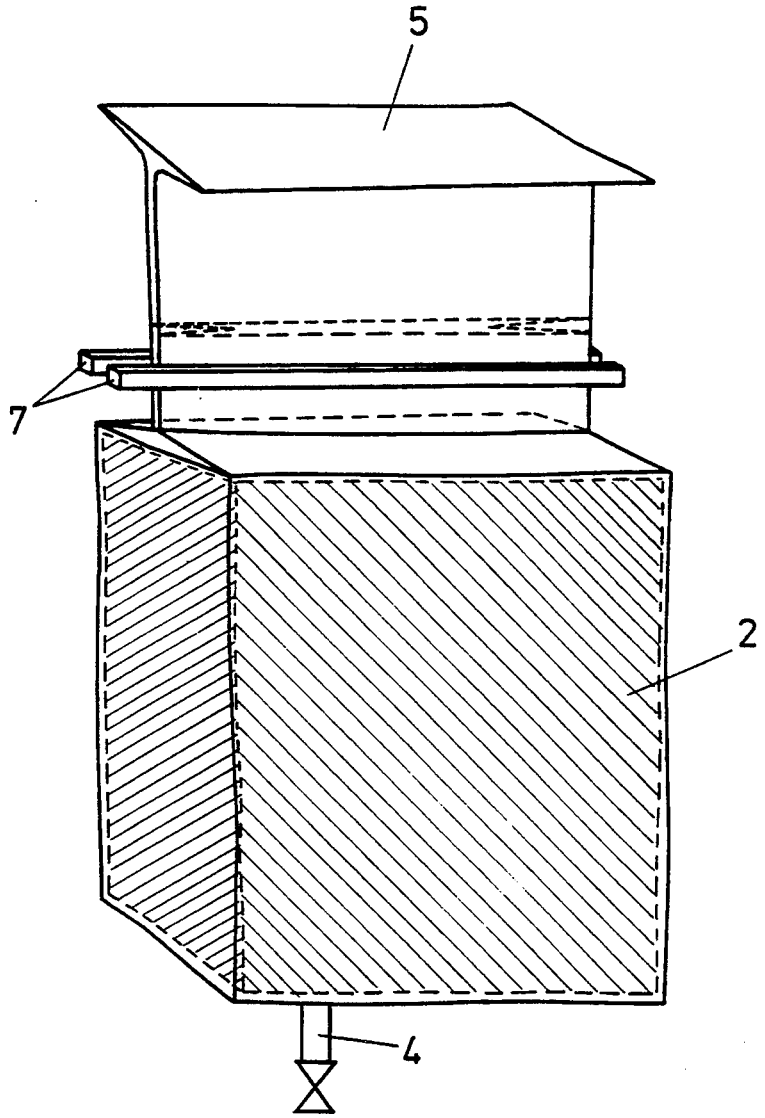
FIG. 3 shows the vacuum chamber of FIG. 2 after the upper end of the package has been folded up by the vacuum chamber.
Figure 5A:
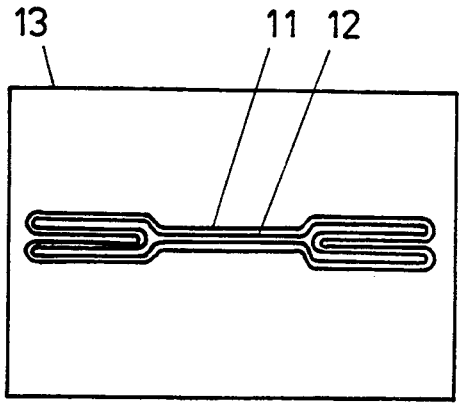
FIGS. 5 and 5A show the situation of FIGS. 4 and 4*a*, respectively, after the upper end of the package has been folded up.
Figure 5:
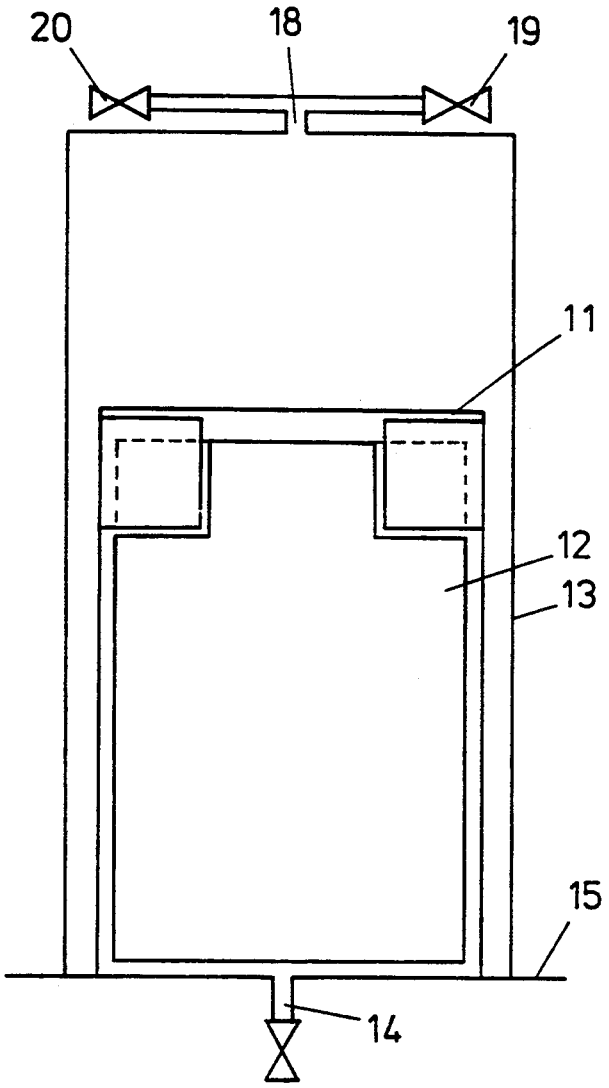

The vacuum chamber 11, provided with folding lines in the same way as the vacuum chamber in FIG. 1, folds inwards under the influence of the difference in pressure outside and inside the vacuum chamber, and thereby folds the package in the same way as the package in FIG. 3. The position and the shape of the folds of the vacuum chamber and the package are visible in FIG. 5 and detailed drawing FIG. 5A drawn on an enlarged scale. The rest of the treatment of the package is as described hereinbefore with respect to FIGS. 1–3.

The apparatus according to FIG. 4 can also be used in a different manner. To that end, after introduction of the package into the vacuum chamber, the vacuum in the space 16 is not removed but maintained, namely, at a value lower than the vacuum to be employed in the vacuum chamber. In that case, while the vacuum chamber and the package are being vacuumized, the pressure in the vacuum chamber remains higher than in the space 16, so that the wall of the vacuum chamber will not fold inwards. Only after the desired degree of vacuum in the vacuum chamber has been achieved is a higher pressure than in the vacuum chamber admitted to the space 16 via valve 19, so that the vacuum chamber folds inwards and thereby folds up the package. This last embodiment has the advantage that during the entire period of vacuumization of the package, the upper end thereof remains entirely open so that a maximum outflow opening is present for rapid and undisturbed vacuumization of the package.

Figure 6:
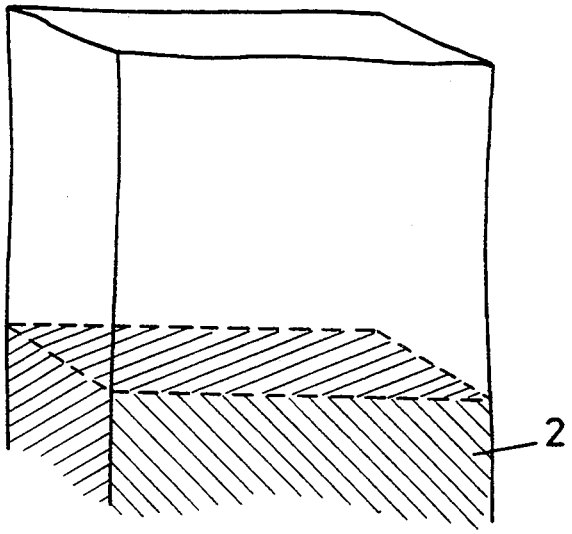
FIG. 6 shows the upper part of the filled package, FIGS. 6A and 6B showing two different possibilities of folding up the upper end of the package.
Figure 6A:
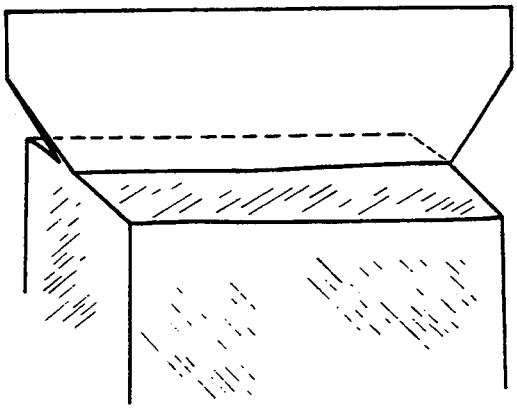
Figure 6B:
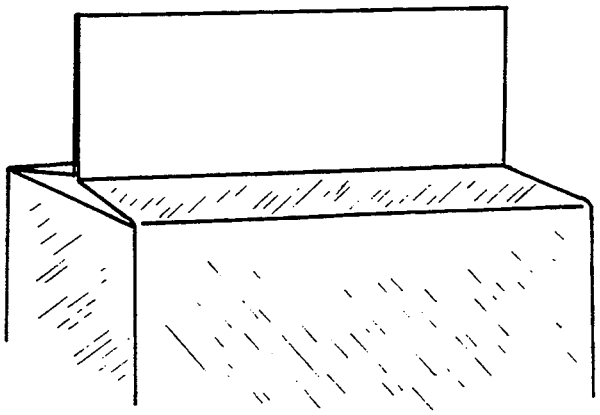
Figure 7:
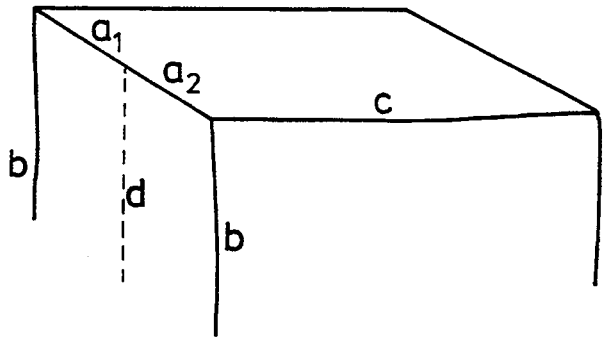
FIG. 7 shows the upper part of a vacuum chamber, FIGS. 7A and 7B showing two different possibilities of folding the upper end of the vacuum chamber.
Figure 7A:
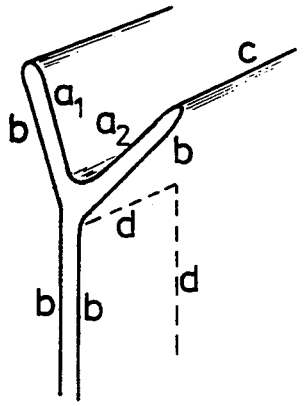
Figure 7B:
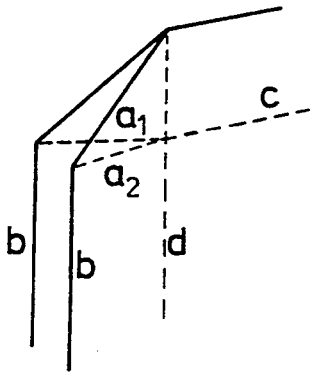

If folding is effected as described hereinabove, an open package as shown in FIG. 6 is formed into a package that is folded up with inwardly directed folds as shown in FIG. 6B. Depending on the design of the vacuum chamber and the folding lines provided therein, and optionally supported by external folding aids, the package can also be folded as shown in FIG. 6A. A vacuum chamber having a top as shown in FIG. 7 can form a folded portion according to the pattern shown in FIG. 7A or FIG. 7B.

Figure 8:
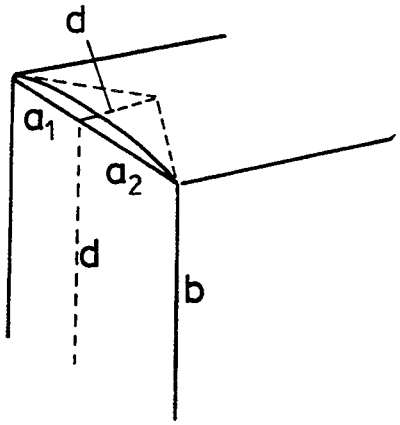
Figure 8A:
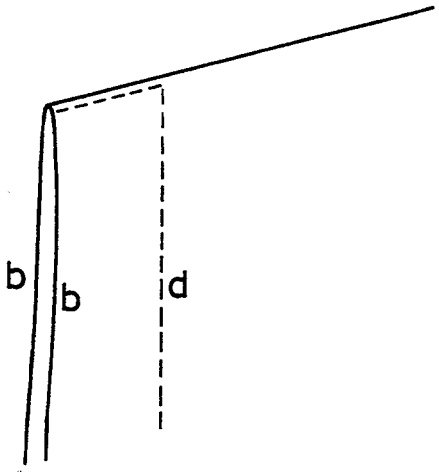
FIG. 8A shows a fold to be formed with this vacuum chamber.

A fold according to FIG. 8A can be obtained with a vacuum chamber according to FIG. 8, which, in inoperative position, is provided with an inwardly turned flap at the top thereof.

The invention is eminently suitable for vacuum packaging fine-grained or powdered products, for instance for the manufacture of a 250 gram vacuum pack filled with ground roasted coffee beans under a vacuum of for instance 50 mbar.

What I claim is:

1. A method for making a filled and closed vacuum pack, comprising the steps of:

introducing a product into a package so that a portion of said package extends above said product;

providing a vacuum chamber with a flexible portion and subjecting said package to said vacuum within said vacuum chamber;

pleating said flexible portion by said vacuum to form a fold in said portion of said package located above said product, whereby said package portion forms a top wall of said package;

sealing said package portion of the filled package.

2. The method according to claim 1, characterized in that said flexible portion of said vacuum chamber folds said package portion by applying a force to the exterior of said vacuum chamber which is greater than the vacuum pressure in said vacuum chamber.

3. The method according to claim 1, characterized in that said product is introduced into a fully open end of said package prior to subjecting said package to said vacuum.

4. The method according to claim 1, characterized in that folding said package portion concludes at substantially the same time said vacuum is achieved.

5. The method according to claim 1, characterized in that opposite walls of said package portion are pressed against each other by and between said flexible portion of said vacuum chamber prior to said sealing.

6. The method according to claim 5, characterized in that said sealing comprises applying heat to said folded package portion with sealing elements built into said flexible portion.

7. The method according to claim 1, characterized in that upon removing said vacuum, said package portion resiliently returns to an unfolded position.

8. The method according to claim 1, further comprising:

after said folding, creating a second vacuum in a space between said vacuum chamber and a rigid container surrounding said vacuum chamber, wherein said second vacuum causes said flexible portion to move toward said rigid container.

9. The method according to claim 1, further comprising:

said vacuum chamber is placed in a rigid container, a second vacuum is maintained in a space between said rigid container and said vacuum chamber while subjecting said package to said vacuum, wherein said second vacuum is lower in pressure than said vacuum; and, during said folding, relatively greater pressure occurs in said space than in said vacuum chamber so as to fold said flexible portion.

10. An apparatus for making a filled and closed vacuum pack, comprising:

a vacuum chamber receiving a package therein, said package receiving a product through an open end so that a portion of said package extends above said product, and said vacuum chamber creating a vacuum around said product in said package;

said vacuum chamber comprises a flexible portion and means for creating a vacuum a said chamber so as to pleat said flexible portion and create a fold in said portion of said package above said product thereby forming a top wall of the package; and, means for sealing said open end of said package.

11. The apparatus according to claim 10, further comprising:

means to apply a relatively greater force to the exterior of said vacuum chamber than said vacuum exerts on the interior of said vacuum chamber, causing said flexible portion to fold said package portion.

12. The apparatus according to claim 11, further comprising:

auxiliary means formed in said flexible portion for causing said flexible portion to fold along desired fold lines.

13. The apparatus according to claim 12, characterized in that said auxiliary means is defined by material thickness deviating from the rest of said flexible portion.

14. The apparatus according to claim 10, characterized in that said flexible portion is formed of resilient material such that said flexible portion springs back into an unfolded position upon removal of said vacuum in said vacuum chamber.

15. The apparatus according to claim 10, characterized in that said sealing means are built into said flexible portion.

16. The apparatus according to claim 10, further comprising:

a rigid container receiving said vacuum chamber with a space between said vacuum chamber and said rigid container; and, a connection for creating a vacuum in said space.

17. The apparatus according to claim 16, further comprising:

a second connection for pressurizing said space with a compressed fluid.

* * * * *